US005194068A

United States Patent [19]

Mohr et al.

[11] Patent Number: 5,194,068

[45] Date of Patent: Mar. 16, 1993

[54] ESTER-CONTAINING FUEL FOR GASOLINE ENGINES AND DIESEL ENGINES

[75] Inventors: Juergen Mohr, Gruenstadt; Knut Oppenlaender, Ludwigshafen; Roland Schwen, Friedelsheim; Hans P. Rath, Gruenstadt; Juergen Thomas, Fussgoenheim; Hans-Henning Vogel, Frankenthal, all of Fed. Rep. of Germany

[73] Assignee: BASF Aktiengesellschaft, Ludwigshafen, Fed. Rep. of Germany

[21] Appl. No.: 720,066

[22] Filed: Jun. 24, 1991

[30] Foreign Application Priority Data

Jun. 29, 1990 [DE] Fed. Rep. of Germany ..... 4020664

[51] Int. Cl.[5] ..... C10L 1/22

[52] U.S. Cl. ..... 44/391; 44/388; 44/399

[58] Field of Search ..... 44/391, 388, 399

[56] References Cited

U.S. PATENT DOCUMENTS

| | | | |
|---|---|---|---|
| 3,088,815 | 5/1963 | Haney | 44/391 |
| 3,448,049 | 6/1969 | Preuss | 44/391 |
| 4,242,101 | 12/1980 | Vogel et al. | 44/58 |
| 4,509,954 | 4/1985 | Ishizaki | 44/399 |
| 4,643,737 | 2/1987 | Sung | 44/391 |
| 4,781,730 | 11/1988 | Stoldt | 44/391 |
| 5,080,690 | 1/1992 | Baillargeon | 44/399 |

FOREIGN PATENT DOCUMENTS

| | | |
|---|---|---|
| 0006527 | 9/1981 | European Pat. Off. . |
| 60-137998 | 7/1985 | Japan . |

*Primary Examiner*—Prince Willis, Jr.
*Assistant Examiner*—Thomas Steinberg
*Attorney, Agent, or Firm*—Herbert B. Keil

[57] ABSTRACT

The invention relates to a fuel for gasoline engines and diesel engines, containing small amounts of an ester of a mono- and/or poly-carboxylic acid with an alkyl alkanolamine or alkyl aminopolyalkylene glycol of the general formula I

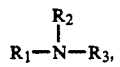

(I)

in which $R_1$ is a $C_6$–$C_{30}$-alkyl radical, $R_2$ is a $C_6$–$C_{30}$-alkyl radical or a hydroxyalkyl radical of the general formula II

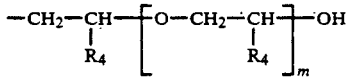

(II)

and $R_3$ is a hydroxylalkyl radical of formula II, in which $R_4$ is hydrogen or a $C_1$–$C_6$-alkyl radical and m is an integer from 0 to 100.

8 Claims, No Drawings

ESTER-CONTAINING FUEL FOR GASOLINE ENGINES AND DIESEL ENGINES

The present invention relates to fuels for gasoline engines and diesel engines containing, as additives, small amounts of esters of alkyl alkanolamines or alkyl aminopolyalkylene glycols with monocarboxylic and/or polycarboxylic acids.

The carburetor and suction system in gasoline engines and also the injection system for metering fuel in gasoline engines and diesel engines become increasingly contaminated by dust particles from the air, by unburned hydrocarbon residues from the combustion chamber and by crankcase breather gases sucked into the carburetor.

When the engine runs under no-load or low-load conditions, these residues effect a shift in the air/fuel ratio to produce a richer mixture. The result is less complete fuel combustion, which in turn increases the proportion of unburned or partially burned hydrocarbons in the exhaust and effects a rise in fuel consumption.

A known method of overcoming such drawbacks is to use fuel additives designed to keep valves, carburetors and injection systems clean (cf., for example, M. Rossenbeck in Katalysatoren, Tenside, Mineralôladditive, edited by J. Falbe and U. Hasserodt, pp. 223 et seq. G. Thieme Verlag, Stuttgart 1978).

At present, such detergent additives are divided into two generations depending on their action and their preferential locus of action.

The first additive generation was only capable of preventing new deposits in the suction system without being able to remove old deposits, whilst modern additives of the second generation can do both ("keep-clean" and "clean-up" effects) and are particularly effective, due to improved thermal properties, in high-temperature zones, i.e. at the inlet valves.

Useful representatives of the second generation are products based on polyisobutenes and, in particular, amides, imides and imide/amides of certain mono- and poly-carboxylic acids.

Particularly noteworthy in this respect are the known active ingredients based on certain amino acid derivative (e.g. ethylene diamino tetraacetic acid) and higher amines (EP 0,006,527). These products are frequently difficult to handle on account of their consistency, for they are mainly highly viscous, pasty or even solid substances which nearly always have to be formulated with a suitable solvent.

Esters of such carboxylic acids, and especially of higher carboxylic acids, with aliphatic alcohols are less frequently used due to the fact that they are difficult to prepare.

In other cases also, for example when certain polymer-based active agents are used, the formulations must contain relatively high-boiling, thermostable solvent components (e.g. mineral oils or synthetic oils) to improve the ability of the products to flow off from the inlet valves.

When formulations not containing such additives have been used, effects such as sticking and jamming of the valves have been observed.

It is thus an object of the present invention to provide fuel additives which are more effective than the prior art additives or produce the same effect at a lower concentration and which are at the same time easy to handle.

We have now found that fuels for gasoline engines and diesel engines have a very good cleaning effect on valves and carburetors of gasoline engines and on the fuel injection systems in gasoline engines and diesel engines when such fuels contain, as additives, small amounts of esters of mono-and/or poly-carboxylic acids with alkyl alkanolamines or alkyl aminopolyalkylene glycols of the formula I

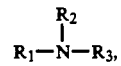

(I)

in which $R_1$ is a $C_6$–$C_{30}$-alkyl radical, $R_2$ is a $C_6$–$C_{30}$-alkyl radical or a hydroxyalkyl radical of the formula II

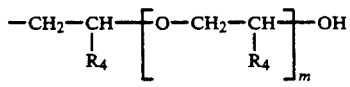

(II)

and $R_3$ is a hydroxylalkyl radical of formula II, in which $R_4$ is hydrogen or a $C_1$–$C_6$-alkyl radical and m is an integer from 0 to 100.

The concentration of ester used in the present invention in the fuels is generally from 10 to 5,000 mg and preferably from 50 to 2,000 mg and more preferably from 100 to 1,000 mg, per kg of fuel.

The ester additives to be used in the present invention are generally synthesized in a number of stages. In a first stage, it is advantageous to produce the alkylalkanolamines or alkyl aminopolyalkylene glycols of the general formula I by alkoxylating, in known manner, primary or secondary amines of the formula III

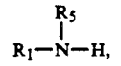

(III)

in which $R_1$ is a $C_6$–$C_{30}$-alkyl radical and preferably a $C_6$–$C_{24}$-alkyl radical and more preferably a $C_6$–$C_{20}$-alkyl radical and $R_5$ is a $C_6$–$C_{30}$-alkyl radical and preferably a $C_6$–$C_{24}$-alkyl radical and more preferably a $C_6$–$C_{20}$-alkyl radical or hydrogen, alkyl radicals $R_1$ and $R_5$ being the same or different, with alkylene oxides having from 2 to 8 carbon atoms and preferably from 2 to 6 carbon atoms and more preferably from 2 to 4 carbon atoms or mixtures of said alkylene oxides. The alkoxylation is optionally carried out in the presence of an alkali such as caustic soda solution, caustic potash solution or sodium methylate, advantageously at elevated temperature, for example a temperature of from 80° to 160° C. and preferably from 100° to 160° C.

Examples of suitable alkylene oxides are ethylene oxide, propylene oxide, 1,2-butylene oxide, isobutylene oxide and 1,2-pentene oxide, ethylene oxide being preferred.

Examples of suitable amines III are hexylamine, dihexylamine, cyclohexylamine, dicyclohexylamine, octylamine, dioctylamine, decylamine, didecylamine, isotridecylamine, diisotridecylamine, cetylamine, dicetylamine, stearylamine, distearylamine, cerylamine and dicerylamine. Preferably, secondary amines are used.

To prepare an alkylalkanolamine I, the amine is reacted in known manner, e.g. in the presence of water, with 1 mole of alkylene oxide or a mixture of alkylene oxides, per mole of secondary amine III or with 2 moles of alkylene oxide or mixture of alkylene oxides per mole of primary amine III (cf. for example S. P. McManus et al. Synth. Commun. 1973, 177).

To prepare an alkyl aminopolyalkylene glycol I, the alkylalkanolamine thus obtained is advantageously reacted with an amount of alkylene oxide such as to cause the index m relating to the hydroxyalkyl radicals to be equal to 1 to 100, preferably 1 to 50 and more preferably 1 to 30.

The resulting compounds of formula I are then converted, in a second stage, to the esters of mono- and/or poly-carboxylic acids by known methods of ester formation, for example by esterification or transesterification methods. Such methods of ester formation are described in HoubenWeyl, "Methoden der Organischen Chemie", Vol. VIII, Sauerstoffverbindungen III (1952), pp. 516 to 555, for example.

Ester formation is generally carried out at a temperature of from 40° to 220° C., preferably from 50° to 200° C. and more preferably from 60° to 180° C. It is preferred to carry out the esterification in the presence of an acid catalyst such as a mineral acid, e.g. sulfuric acid, phosphoric acid or p-toluenesulfonic acid, or a Lewis acid, e.g. $BF_3$ and dibutyltin laurate. It may be advantageous to remove the water of esterification by azeotropic distillation, this being effected by carrying out the esterification in the presence of a volatile water-insoluble diluent such as benzene, toluene, xylene or even chloroform and carbon tetrachloride.

The preparation of an ester by transesterification is conveniently carried out starting from an ester of a mono- and/or poly-carboxylic acid with a lower alcohol such as methanol, ethanol and propanol by reacting this with a compound of the general formula I in the presence of a basic or acidic catalyst, preferably a Lewis acid catalyst, advantageously with removal of the liberated alcohol by distillation.

Examples of suitable carboxylic acids to form the basis of such esters are aliphatic, cycloaliphatic and aromatic mono- and poly-carboxylic acids, which may be substituted to form hydroxymonocarboxylic acids and hydroxypolycarboxylic acids or amino-, imino- and nitrilo-monocarboxylic acids and amino-, imino- and nitrilo-polycarboxylic acids. These carboxylic acids generally have from 4 to 26, preferably from 5 to 20, carbon atoms. The polycarboxylic acids preferably used are generally those having from 2 to 6, preferably from 2 to 4, carboxyl groups.

Examples of suitable aliphatic monocarboxylic acids are capronic acid, n-heptylic acid, caprylic acid, capric acid, lauric acid, myristic acid, palmitic acid and stearic acid. Examples of suitable aromatic monocarboxylic acids are benzoic acid and substituted benzoic acids such as the toluic acids.

Examples of suitable aliphatic polycarboxylic acids are dicarboxylic acids such as succinic acid, glutaric acid, adipic acid, pimelic acid, suberic acid, azelaic acid, sebacic acid and citric acid. Examples of suitable aromatic polycarboxylic acids are phthalic acid, terephthalic acid, isophthalic acid, trimellitic acid, hemimellitic acid, trimesic acid, pyromellitic acid and mellitic acid.

Other suitable polycarboxylic acids are nitriloacetic acid and ethylenediaminotetraacetic acid.

The esters to be used in the invention are generally obtained in the form of colorless to pale yellow oily products, some of which are viscous. Their physical properties render them similar to lubricating oils.

The most conspicuous and surprising property of the esters to be used in the present invention is their excellent thermostability, as shown by thermogravimetric and differential thermoanalytic measurements.

Another surprising feature is the fact that the esters to be used in the invention can be prepared in a simple manner and in good yields from the higher carboxylic acids and the aminoalkanol compounds I, as it is well known that esters of such carboxylic acids with aliphatic alcohols, i.e. alcohols not containing any amino groups, are often difficult to manufacture.

It may be advantageous to combine the esters used as detergent additives with so-called carrier oils. Such carrier oils have an additional washing function and frequently show a synergistic effect in combination with detergents. The carrier oils are usually high-boiling, viscous and thermostable liquids. They form a thin liquid film on the hot metal surface (for example of the inlet valves) and thus hinder or prevent the formation or deposition of decomposition products on the metal surface. In practice, the carrier oils used are often high-boiling refined mineral oil cuts (usually vacuum distillates). A particularly good carrier oil is Brightstock in combination with lower-boiling highly refined lubricating oil cuts. Other carrier oils are synthetic products. Particularly esters have been described as being suitable carrier oils (cf. for example DE 1,062,484, DE 2,129,461 and DE 2,304,086).

The carrier oils are usually added to the fuels in a concentration of from 50 to 5,000 mg, preferably from 100 to 2,000 mg, per kg of fuel.

Tests on the suitability of the esters as additives, particularly as valve and carburetor detergents, are carried out by engine tests as specified by CEC-F-02-T 79 using an Opel Kadett 1.2 l engine.

A) SYNTHESIS EXAMPLES

1. Preparation of alkyldiakanolamines or dialkylalkanolamines

The alkylamine or dialkylamine is placed in a pressure vessel together with 5% w/w of water. The vessel is flushed with nitrogen a number of times and then heated to the temperature suitable for the alkylene oxide used, e.g.

from 120° to 125° C. for ethylene oxide,
from 130° to 135° C. for propylene oxide,
from 140° to 150° C. for butylene oxide.

The alkylene oxide is then added with stirring under a pressure of from 10 to 30 bar in an excess of 10% molar over the amine N-H bonds to be reacted. By this means, primary amines are di-alkoxylated.

On completion of the reaction, volatile portions and water are totally removed in vacuo.

The β-aminoalkanols thus obtained are used in the subsequent esterification.

2. Preparation of alkylamino bis-polyalkylene glycols or dialkylamino polyalkylene glycols A dehydrated mixture of the β-aminoalkanol of Example 1 forming the starting material and a quantity of KOH equivalent to approx. 0.1% of the total weight of the reaction product is placed in a pressure vessel. The vessel is flushed several times with nitrogen and heated to the appropriate temperature as given in Example 1, after which the alkylene oxide is added with stirring while the temperature is held constant and the pressure is kept at from 10 to 30 bar, the addition being continuous or non-continuous and effected through a submerged pipe or onto the surface of the reaction mixture until the desired viscosity is reached.

The volatile components are completely removed in vacuo and the reaction product is clarified, if necessary, by filtration.

3. Reaction of adipic acid with diisotridecyl ethanolamine

1 Mole of adipic acid, 2.1 moles of diisotridecyl ethanolamine prepared by the method described in Example 1, 1 g of dibutyltin laurate and 1.5 l of xylene are mixed together and the mixture is heated under reflux via a water trap until the theoretical content of water has been separated.

The solvent is removed by distillation, in the final phase with the aid of a water jet vacuum, and the reaction product is filtered if necessary. The di-adipate is obtained as a yellow oil.

4. Reaction of trimellitic anhydride with diisotridecyl ethanolamine

Following the procedure described in Example 3, 1 mole of trimellitic anhydride and 3.1 moles of diisotridecyl ethanolamine are reacted to give the corresponding trimellitic triester.

5. Reaction of ethylenediaminotetraacetic acid with diisotridecyl ethanolamine

Following the procedure described in Example 3, 1 mole of ethylenediaminotetraacetic acid and 4.2 moles of diisotridecyl ethanolamine are reacted to give the corresponding tetra-ester.

B) Examples of Application

The Table below lists the results of the application tests. The comparison is made between the effect of prior art detergents and that of alkanolamine carboxylates used in the present invention with and without the use of synthetic carrier oils, in gasoline as fuel for internal combustion engines. The amounts of detergents and carrier oils given in the Table were added to super grade gasoline (unleaded, RON 95) as specified by DIN 51,607, which was used on the test bench using an Opel Kadett engine according to the specification of CEC-F-02-T-79. The engine oil used was reference oil RL 51.

TABLE

Cleaning action in Opel Kadett engine using various additives

| Example No. | Additive | Amount added [mg/kg] | Average deposition per inlet valve |
|---|---|---|---|
| 1 | polyisobutylamine, $M_w$ approx. 1,000 (as per EP 244,616) + | 250 | 15 |
| | polypropylene glycol (viscosity 100 $mm^2/s$ at 40° C.) | 250 | |
| 2 | polycarbonamide (as per DE-OS 2,624,630) + | 250 | 49 |
| | polybutylene glycol (viscosity 35 $mm^2/s$ at 40° C.) | 250 | |
| 3 | diisotridecylaminoethyl adipate of Synthesis Example 3 + | 250 | 15 |
| | polybutylene glycol used in Example No. 2 | 250 | |
| 4 | tris(diisotridecylaminoethyl) trimellitate of Synthesis Example 4 + | 250 | 0 |
| | polybutylene glycol used in Example 2 | 250 | |
| 5 | tetrakis(diisotridecylaminoethyl) ethylenediaminotetraacetate of Synthesis Example 5 + | 250 | 12 |
| | polybutylene glycol of Ex. 2 | 250 | |
| 6 | tetrakis(diisotridecylaminoethyl) ethylenediaminotetraacetate of Synthesis Example 5 | 400 | 0 |

Application Examples 1 and 2 are comparative tests
Application Examples 3 and 6 are tests on additives of the invention The stated amounts of detergent refer to the pure active substance without solvent.

We claim:

1. A fuel for gasoline engines and diesel engines, containing small amounts of an ester which is the reaction product of a polycarboxylic acid and an alkyl alkanolamine or alkyl aminopolyalkylene glycol of the formula I

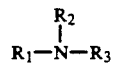

I in which $R_1$ and $R_2$ are $C_6$–$C_{30}$-alkyl radicals and $R_3$ is a hydroxyalkyl radical of formula II,

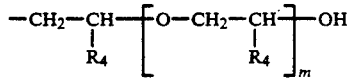

II in which $R_4$ is hydrogen or a $C_1$–$C_6$-alkyl radical and m is an integer of from 0 to 100.

2. A fuel as defined in claim 1, wherein the polycarboxylic acid has from 2 to 4 carboxyl groups.

3. A fuel as defined in claim 1, containing from 10 to 5,000 mg of ester per kg of fuel.

4. A fuel as defined in claim 1, containing from 50 to 2,000 mg of ester per kg of fuel.

5. A fuel as defined in claim 1, containing from 100 to 1,000 mg of ester per kg of fuel.

6. A fuel as defined in claim 1, wherein m is an integer of from 1 to 100.

7. A fuel as defined in claim 1, wherein m is an integer of from 1 to 50.

8. A fuel as defined in claim 1, wherein m is an integer of from 1 to 30. i

* * * * *

UNITED STATES PATENT AND TRADEMARK OFFICE

CERTIFICATE OF CORRECTION

PATENT NO. : 5,194,068

DATED : March 16, 1993

INVENTOR(S) : MOHR et al.

It is certified that error appears in the above-identified patent and that said Letters Patent is hereby corrected as shown below:

Column 6, line 63, claim 8, after "30"., delete "i".

Signed and Sealed this

Sixteenth Day of November, 1993

*Attest:*

Bruce Lehman

BRUCE LEHMAN

*Attesting Officer*

*Commissioner of Patents and Trademarks*